US007143831B2

(12) United States Patent
Budde

(10) Patent No.: US 7,143,831 B2
(45) Date of Patent: Dec. 5, 2006

(54) APPARATUS FOR RELEASING A BALL INTO A WELLBORE

(75) Inventor: Marcel Budde, Vlaardingen (NL)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/867,960

(22) Filed: Jun. 15, 2004

(65) Prior Publication Data

US 2004/0231836 A1 Nov. 25, 2004

Related U.S. Application Data

(62) Division of application No. 10/208,724, filed on Jul. 30, 2002, now Pat. No. 6,802,372.

(51) Int. Cl.
*E21B 33/12* (2006.01)

(52) U.S. Cl. ..... 166/373; 166/192; 166/381

(58) Field of Classification Search ..... 166/192, 166/193, 373, 374, 381, 324, 332.7, 334.4
See application file for complete search history.

(56) References Cited

U.S. PATENT DOCUMENTS

| | | | | |
|---|---|---|---|---|
| 2,117,536 | A | 5/1938 | Baker et al. | |
| 3,545,542 | A | 12/1970 | Scott | |
| 4,893,678 | A | 1/1990 | Stokley et al. | |
| 5,036,922 | A * | 8/1991 | Braddick | 166/383 |
| 5,335,727 | A | 8/1994 | Cornette et al. | |
| 5,413,172 | A | 5/1995 | Laurel | |
| 5,511,618 | A | 4/1996 | Budde | |
| 5,533,667 | A | 7/1996 | Gale | |
| 5,662,169 | A | 9/1997 | Hosie | |
| 5,669,443 | A | 9/1997 | Budde et al. | |
| 5,680,902 | A | 10/1997 | Giroux et al. | |
| 5,690,177 | A | 11/1997 | Budde | |
| 5,746,274 | A * | 5/1998 | Voll et al. | 166/278 |
| 5,787,979 | A | 8/1998 | Giroux et al. | |
| 5,813,457 | A | 9/1998 | Giroux et al. | |
| 5,836,395 | A | 11/1998 | Budde | |
| 5,909,771 | A | 6/1999 | Giroux et al. | |
| 6,003,607 | A | 12/1999 | Hagen et al. | |

(Continued)

OTHER PUBLICATIONS

"Sub-Surface Release Cementing Plug System," Weatherford Elastomer Products, Weatherford/Lamb, Inc., Brochure No. 94.01, 1997, 4 Pages.

(Continued)

*Primary Examiner*—William Neuder
*Assistant Examiner*—Daniel P Stephenson
(74) *Attorney, Agent, or Firm*—Patterson & Sheridan, LLP

(57) ABSTRACT

The present invention relates to an apparatus for dropping a ball into a wellbore. The apparatus is particularly useful for dropping a ball that has a diameter that is larger than the diameter of a bore within a wellbore tool above the apparatus. The ball-releasing apparatus first comprises a tubular body. The tubular body has a bore therethrough that is in fluid communication with the bore of the wellbore tool. A piston is placed within the tubular body. The piston has a top end disposed within the tubular body, and a bottom end disposed below the bore of the wellbore tool. The ball-releasing apparatus further comprises a connector for releasably connecting the piston to the ball. In one arrangement, the ball-releasing apparatus is connected to the bottom of a wiper plug for dropping a ball during a wellbore cementing operation. In one aspect, the ball is dropped by dropping a second ball having a diameter that will pass through the wellbore restriction, and then injecting fluid under pressure against the second smaller ball in order to actuate the releasable connection.

14 Claims, 9 Drawing Sheets

U.S. PATENT DOCUMENTS

| | | | | |
|---|---|---|---|---|
| 6,056,053 | A | 5/2000 | Giroux et al. | |
| 6,082,451 | A | 7/2000 | Giroux et al. | |
| 6,129,152 | A | 10/2000 | Hosie et al. | |
| 6,131,662 | A | 10/2000 | Ross | |
| 6,155,350 | A | 12/2000 | Melenyzer | |
| 6,209,663 | B1 | 4/2001 | Hosie | |
| 6,220,360 | B1 | 4/2001 | Connell et al. | |
| 6,227,306 | B1 | 5/2001 | Downie et al. | |
| 6,263,982 | B1 | 7/2001 | Hannegan et al. | |
| 6,318,472 | B1 * | 11/2001 | Rogers et al. | 166/382 |
| 6,343,658 | B1 | 2/2002 | Webb | |
| 6,390,200 | B1 | 5/2002 | Allamon et al. | |
| 6,419,015 | B1 | 7/2002 | Budde et al. | |
| 6,491,103 | B1 | 12/2002 | Allamon et al. | |
| 2001/0045288 | A1 | 11/2001 | Allamon et al. | |

OTHER PUBLICATIONS

International Search Report, International Application No. PCT/US 03/23670, dated Feb. 20, 2004.

* cited by examiner ( SECTION C-C )

APPARATUS FOR RELEASING A BALL INTO A WELLBORE

CROSS-REFERENCE TO RELATED APPLICATIONS

This application is a divisional of U.S. patent application Ser. No. 10,208,724, filed Jul. 30, 2002 now U.S. Pat. No. 6,802,372. Each of the aforementioned related patent applications is herein incorporated by reference.

BACKGROUND OF THE INVENTION

1. Field of the Invention

The present invention generally relates to an apparatus for dropping balls into a wellbore. More particularly, the invention relates to a sub, such as a cement plug, capable of selectively releasing balls and other objects into a wellbore, such as during cementing operations. The invention further relates to a pressure equalizer and cross-over device as might be employed during a fluid circulation operation.

2. Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of casing. An annular area is thus formed between the string of casing and the formation. A cementing operation is then conducted in order to fill the annular area with cement. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps the lower portion of the first string of casing. The second liner string is then fixed or "hung" off of the existing casing. Afterwards, the second casing string is also cemented. This process is typically repeated with additional liner strings until the well has been drilled to total depth. In this manner, wells are typically formed with two or more strings of casing of an ever-decreasing diameter.

In the process of forming a wellbore, it is sometimes desirable to utilize various plugs. Plugs typically define an elongated elastomeric body used to separate fluids pumped into a wellbore. Plugs are commonly used, for example, during the cementing operation for a liner. Plugs are also used during subsea operations for cementing casing.

The process of cementing a liner or other casing string into a wellbore typically involves the use of two different types of plugs—liner wiper plugs and drill-pipe darts. The first plug used is a liner wiper plug. The liner wiper plug is typically run into the wellbore with the liner at the bottom of a working string. The liner wiper plug has radial wipers to contact and wipe the inside of the liner as the plug travels down the liner.

The liner wiper plug has a cylindrical bore formed therein to receive fluids as the liner is lowered into the wellbore. After a sufficient volume of circulating fluid or cement has been placed into the wellbore, a first drill pipe dart or pump-down plug, is deployed. Using drilling mud, cement, or other displacement fluid, the dart is pumped into the working string. As the dart travels downhole, it seats against the liner wiper plug, closing off the internal bore through the liner wiper plug. Hydraulic pressure above the dart forces the dart and the wiper plug to dislodge from the bottom of the working string and to be pumped down the liner together. This forces the circulating fluid or cement that is ahead of the wiper plug and dart to travel down the liner and out into the liner annulus.

In many fluid circulation operations, it is desirable to employ a multi-plug system. In a multi-plug system, two or more plugs are stacked one on top of the other. Each plug has a hollow mandrel defining a fluid passageway therein. Further, each hollow mandrel includes a seat for receiving a separate dart or ball. A first "bottom" plug is launched by dropping a first dart down the working string until it lands in the bottom seat. Fluid is injected into the working string under additional pressure, causing the bottom plug, with the dart landed therein, to be separated from the top plug or plugs. Typically, separation is accomplished by applying sufficient pressure to overcome a shearable connection along the mandrel, and a collet connection.

The bottom wiper plug and dart are commonly used to separate a column of wellbore fluid from a column of cement. The bottom wiper plug and dart are pumped downhole ahead of the cement slurry. The bottom wiper plug and dart exit the working string and travel down the liner. Ultimately, the bottom wiper plug and dart land in a float collar disposed proximate to the bottom of the liner. Pressure is again raised within the wellbore, causing a disk within the bottom plug to burst. Cement is then allowed to flow through the bottom plug and up the annulus outside of the liner.

After a sufficient volume of cement has been injected into the wellbore, a second dart is dropped from the surface. The second dart lands in the fluid passageway of the second (usually, the top) wiper plug. This again effectuates a substantial seal of fluid within the wellbore. Fluid continues to be injected into the wellbore, raising the pressure against the top plug. A shearable connection between the top plug and the mandrel is sheared, allowing the top plug and top dart to be pumped downhole, thereby pushing cement down the liner and then back up the annulus.

Certain limitations and disadvantages exist with the use of cement wiper plugs. The first limitation relates to the restricted size of the mandrel within the plugs. Those of ordinary skill in the art will appreciate that the mandrel in the bottom plug must be smaller than the mandrel in the top plug. This is necessary in order to allow the bottom dart to pass through the seat in the top plug so as to release the bottom plug without releasing the top plug. The restricted bore diameter in the mandrel of the bottom plug serves as a limitation to the rate at which fluid can be pumped downhole. It further serves as a limitation as to the size of balls that can be dropped through the wiper plugs in order to actuate tools further downhole, e.g., an auto-fill float collar disposed near the bottom of the liner. Of course, other tools deployed in the wellbore during a cementing operation will also have a limited diameter available. Thus, one problem frequently encountered in many wellbore operations is the need to overcome the limitation of a restriction in the wellbore that prevents the use of a ball below that restriction. In other words, a ball having a greater diameter than the bore of a tool cannot be dropped through that tool. Typically, a ball having a maximum diameter of 2.25 inches can be used.

For purposes of the present application, the term "ball" includes any spherical or other object, e.g. bars, and plugs, that are dropped into a wellbore. Typically a ball is used downhole to activate a tool or to temporarily seal the wellbore.

A present application pending before the United States Patent and Trademark Office addresses a system that permits a larger-diameter ball to be dropped from below the point of a wellbore restriction. That application is US 2001/0045288, published Nov. 29, 2001. The listed inventor is Allamon. In one embodiment, shown in FIGS. 8 and 9 therein, a sub is attached to the bottom of a cement plug. The sub includes a large-ball seat for receiving a larger-diameter ball. The sub also includes a smaller seat for receiving a smaller, releasing ball. Further, the sub includes a sleeve that moves downward in response to pressure after the smaller ball has been dropped and seated, thereby closing off flow-through ports. The larger-diameter ball is released through the injection of fluid under pressure after the smaller, releasing ball is dropped and after the flow-through ports are closed. The seats are fabricated from a yieldable material such as aluminum that permits the balls to drop at a predetermined level of fluid pressure.

The above pending application has utility in the dropping of a ball that would otherwise be of a diameter that is too large to pass through the restrictions above the liner wiper plug. However, the described system requires refabrication of the liner wiper plug to accommodate an integral ball releasing apparatus, to wit, a frangible seat within the plug. It further requires fabrication of ports in the plug above the seat for the larger ball.

Another disadvantage to the use of a dual or multi-plug system relates to the potential for excessive pressure building up on the outside of the top plug after the bottom plug has been launched. This condition may arise in a variety of circumstances. For example, if a portion of formation collapses around the liner prior to or during a cementing operation, it is necessary to raise the level of circulation pressure in order to circulate out the bridged formation. In this instance, circulation fluid will exit relief ports within the working string and act downwardly against the top plug from outside of the working string. This creates the potential for premature launch of the top plug.

The presence of unwanted pressure on the outside of the top wiper plug may also arise during the setting of an auto-fill float collar. Unwanted pressure buildup could also occur while actuating a hydraulically set liner hanger, or during a staged cementing operation.

To overcome the problem of excessive pressure acting against the top plug from outside of the working string, some drilling operators utilize a pressure equalizer tool. A pressure equalizer tool is typically installed in the working string above the cement plug and below the running tool. The pressure equalizer allows fluid to be received back into the working string from above the cement plug where a positive pressure differential is sensed. However, this requires the deployment of a separate tool on top of the cement plugs.

Therefore, there is a need for a more effective plug-dropping apparatus for a cementing plug. There is a further need for a cementing plug having a mechanism for suspending and selectively releasing a ball, thereby overcoming wellbore restrictions within and above the cement plug. Still further, there is a need for a ball-releasing mechanism that can be easily installed into a conventional cement plug. Further still, there is a need for a cement plug having an integral pressure equalizer/cross-over tool.

SUMMARY OF THE INVENTION

The present invention generally relates to a ball-releasing apparatus for use in activating downhole tools. The ball-releasing apparatus enables the operator to bypass a restriction in the wellbore, and to drop a ball having a larger diameter than could otherwise be dropped from the surface.

The ball-releasing apparatus first comprises a tubular body. The top end of the tubular body is connected to a wellbore tool proximate to the bottom end of the wellbore tool. The wellbore tool has a bore or other fluid flow path for permitting fluids to be circulated therethrough. Preferably, the wellbore tool is a wiper plug as would be used in a cementing operation. The tubular body has a bore that is in fluid communication with the bore of the wellbore tool.

A piston is placed within the tubular body of the ball-releasing apparatus. The piston has a top end disposed within the tubular body, and a bottom end disposed below the bore of the wiper plug. The piston is slidable within the tubular body. In one arrangement, the piston is initially maintained in place within the tubular body by a shear pin. The shear pin is sheared when the ball-releasing apparatus is actuated.

The ball-releasing apparatus further comprises a connector for releasably connecting the piston to the ball. The connector is disposed proximate to the bottom of the tubular body, and initially suspends the ball below the wiper plug or other wellbore tool. In one arrangement, the releasable connector comprises a collet having a body and a plurality of fingers. The fingers extend into a recess in the ball in order to form the initial connection.

The ball-releasing apparatus is actuated by injecting fluid under pressure into the wellbore. In one aspect, actuation is further accomplished by dropping a second ball having a diameter that will pass through the wellbore restriction. The second ball acts against the piston so as to shear the pin and then to urge the piston downward into the recess of the larger first ball. The downward force of the piston causes the collet fingers to collapse, thereby releasing the larger ball.

In one aspect of the invention, a cross-over equalizer tool is attached at a top end of the wiper plug. The cross-over equalizer tool provides fluid communication between the outside of the working string and the bore of the wiper plug in the event that pressure outside of the working string exceeds a desired level greater than pressure within the wiper plug. The cross-over equalizer tool generally comprises an outer housing and an inner housing. The outer housing defines a tubular body that has an inner surface and an outer surface. The inner housing also defines a tubular member, and is disposed essentially concentrically within the inner surface of the inner housing surface. A bore is formed within the inner housing for receiving the mandrel of the wiper plug.

The cross-over equalizer tool also has a fluid channel. The fluid channel is defined by the inner surface of the outer housing, and the inner housing. The fluid channel has an opening in fluid communication with the outer surface of the outer housing. In one arrangement, the opening is at the bottom of the fluid channel.

One or more cross-over ports are placed along the inner housing. The cross-over ports place the bore of the mandrel of the wiper plug in fluid communication with the fluid channel. In accordance with the operation of the cross-over equalizer tool, the bore of the wiper plug is placed in fluid communication with the outer surface of the outer housing via the fluid channel when fluid pressure on the outer surface of the outer housing exceeds fluid pressure in the bore of the wiper plug by a selected amount. In one aspect, a piston is placed within the fluid channel. The piston is biased in a sealing position that prevents fluid from traveling from the outside of the cross-over equalizer tool into the bore of the wiper plug. Pressure acting from outside of the plug at a certain level will overcome the piston's sealing position, creating fluid communication between the outer surface of the outer housing and the bore of the wiper plug, thereby equalizing pressures.

BRIEF DESCRIPTION OF THE DRAWINGS

So that the manner in which the above recited features of the present invention are attained and can be understood in detail, a more particular description of the invention, briefly summarized above, may be had by reference to the appended drawings. It is to be noted, however, that the appended drawings illustrate only typical embodiments of this invention and are not to be considered limiting of its scope, for the invention may admit to other equally effective embodiments.

DETAILED DESCRIPTION OF THE PREFERRED EMBODIMENT

Figure 1B:
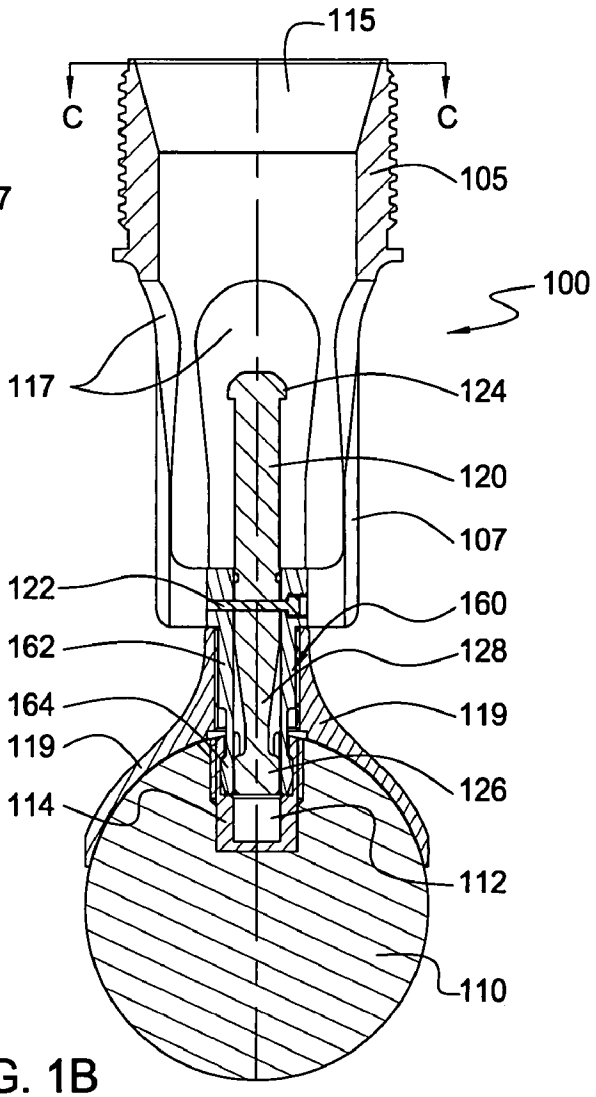
FIG. 1B is a cross-sectional view of the ball-releasing apparatus of FIG. 1A.
Figure 1C:
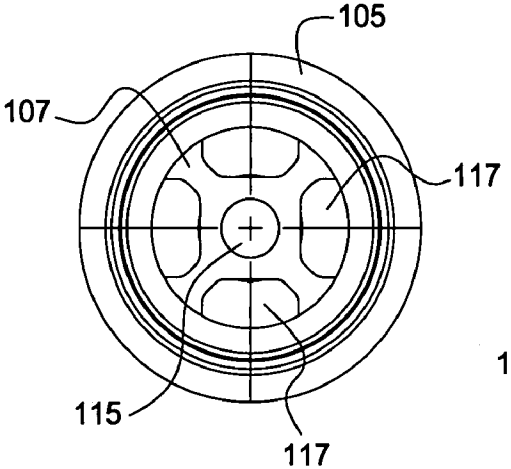
FIG. 1C is a top, cross-sectional view taken across line C—C of FIG. 1B.
Figure 1A:
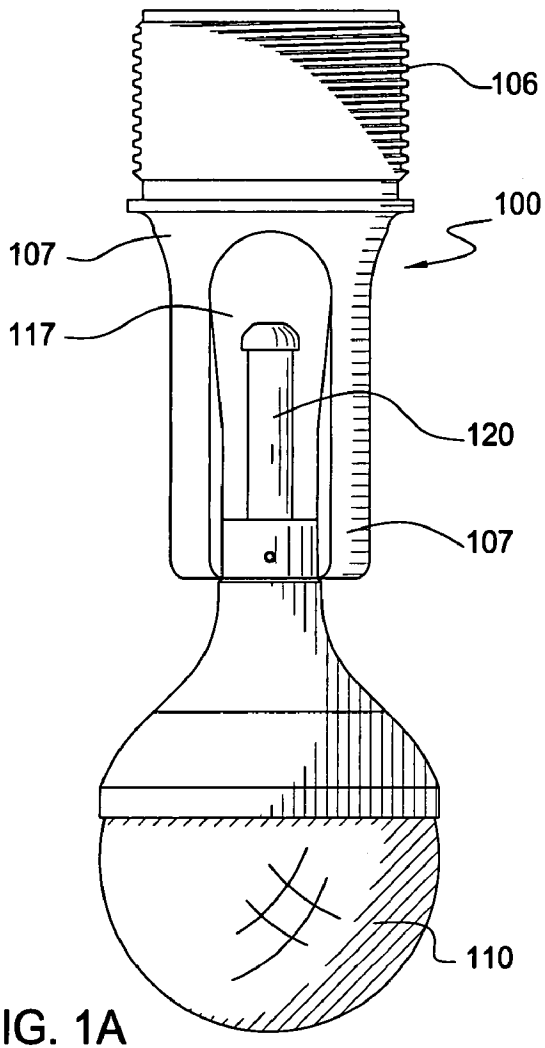
FIG. 1A presents a perspective view of a ball-releasing apparatus, in one embodiment, of the present invention. A larger ball remains attached to the ball-releasing apparatus.

FIG. 1A presents a perspective view of a ball-releasing apparatus 100, in one embodiment, of the present invention. The ball-releasing apparatus 100 provides a novel mechanism for selectively releasing a larger ball 110 into a wellbore from a point below a wellbore restriction. The larger ball 110 is shown releasably attached to the ball-releasing apparatus 100. FIG. 1B is a cross-sectional view of the ball-releasing apparatus 100 of FIG. 1A. FIG. 1C is a top, cross-sectional view taken across line C—C of FIG. 1B.

The ball-releasing apparatus 100 first comprises a tubular body 105. The body 105 is configured and dimensioned to be received at the lower end of a mandrel within a wellbore tool (not shown in FIGS. 1A–1C). Preferably, the upper end of the body 105 has external threads 106 that allow the ball-releasing mechanism 100 to be quickly and simply screwed into the lower end of the mandrel.

Figure 2A:
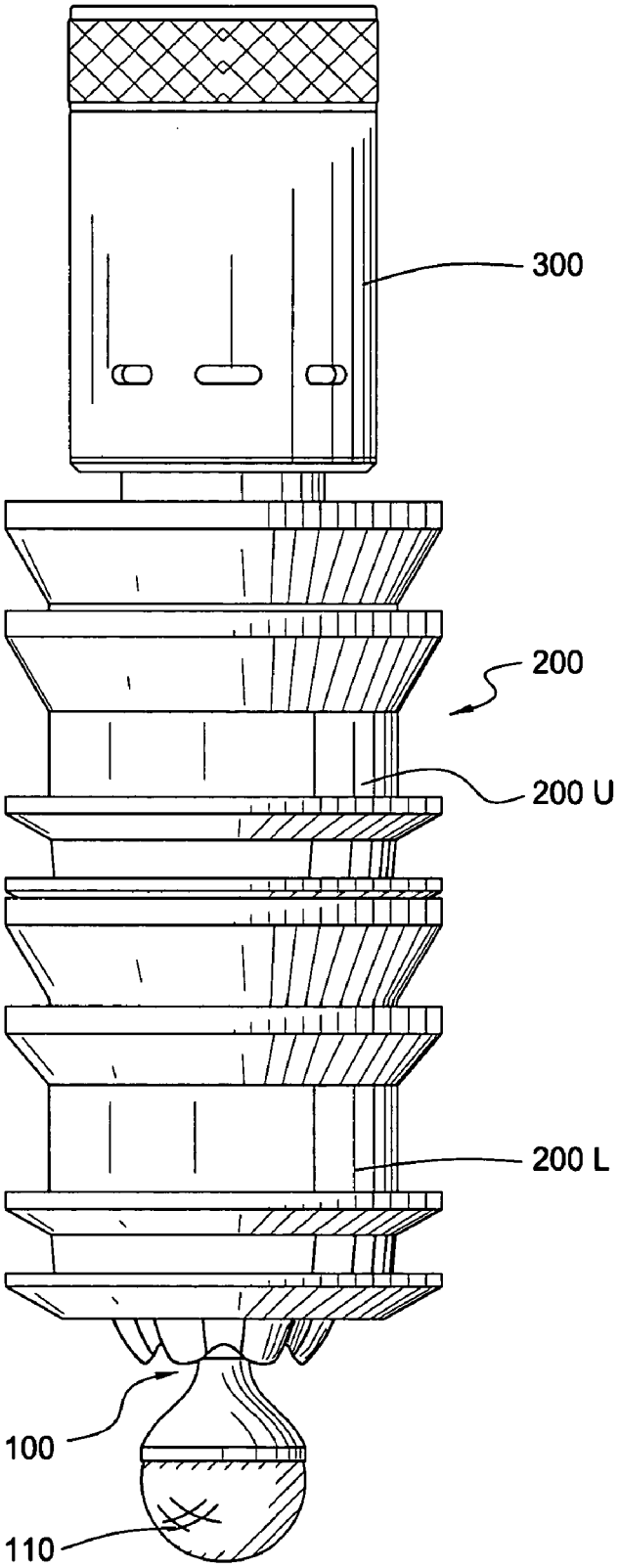
FIG. 2A presents a perspective view of a cement plug having a cross-over equalizer tool integral thereto. A ball-releasing apparatus of the present invention is fabricated within the cement plug. A larger ball is shown suspended from the cement plug by means of a ball-releasing apparatus.
Figure 2B:
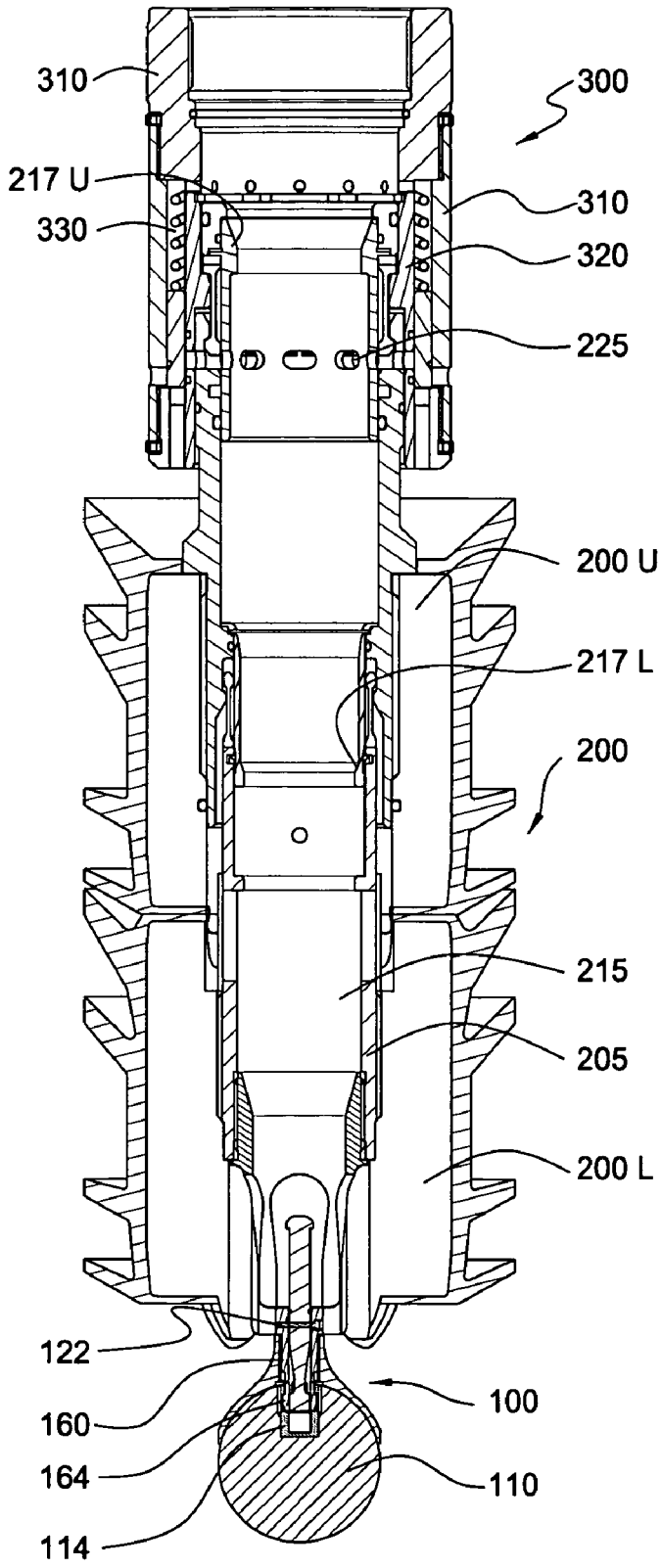
FIG. 2B presents a cross-sectional view of the cement plug of FIG. 2A. The cross-over device is shown in it run-in position.

An example of a wellbore tool 200 for receiving the ball-releasing apparatus 100 is shown in FIGS. 2A and 2B. Here, the wellbore tool 200 is a cement plug. FIG. 2A presents a perspective view of the cement plug 200 having a cross-over equalizer tool 300 integral thereto. A ball-releasing apparatus 100 of the present invention is attached to the bottom of the cement plug 200. A larger ball 110 is shown suspended from the cement plug 200 by means of the ball-releasing apparatus 100.

FIG. 2B presents a cross-sectional view of the cement plug 100 of FIG. 2A. The cross-over equalizer device 300 is again attached. The cross-over equalizer device 300 is shown in it run-in position. Details concerning the features of the cross-over equalizer tool 300 will be described below.

Figure 3:
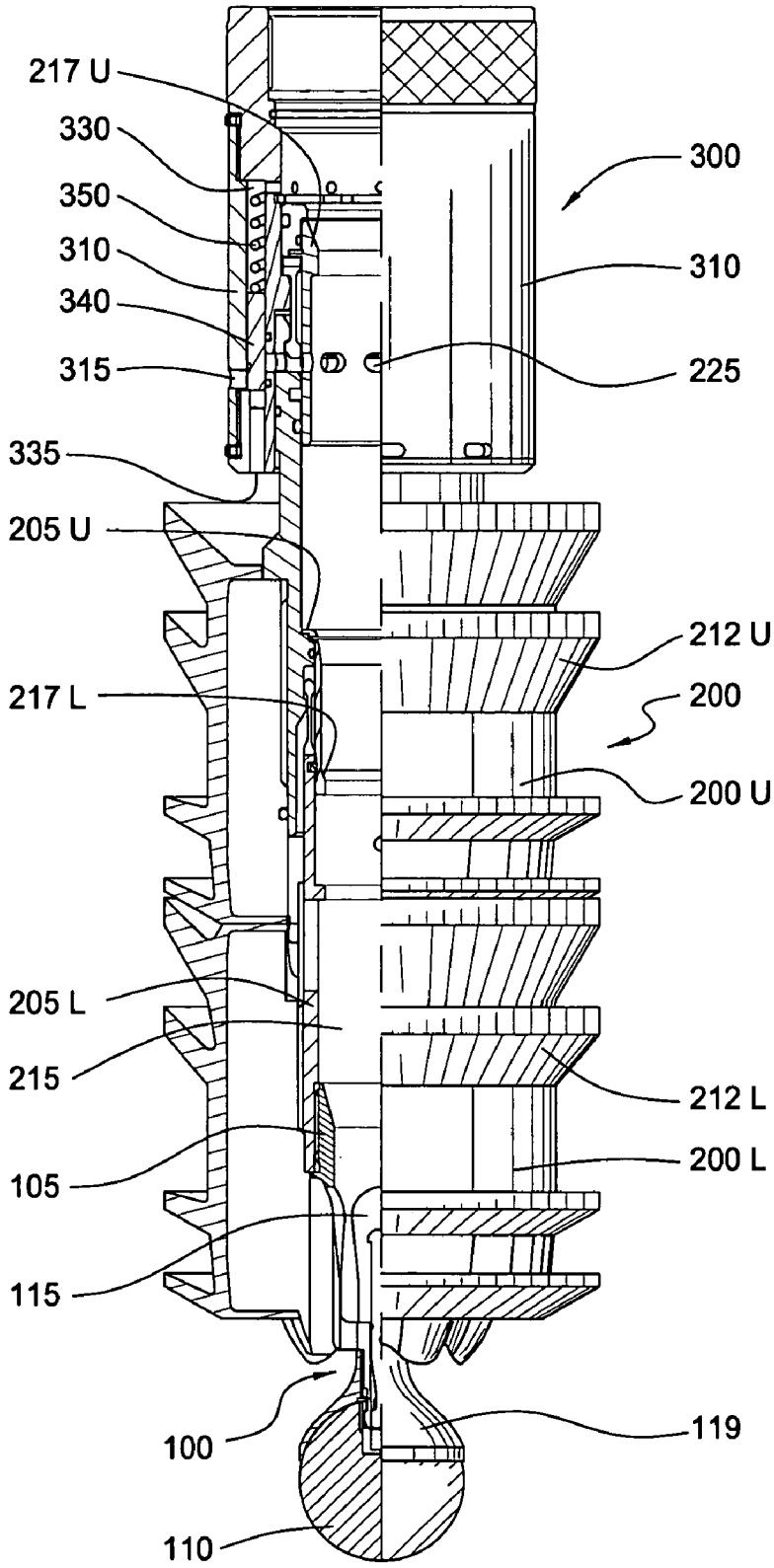
FIG. 3 is a cut-away view of the cement plug of FIGS. 2A and 2B.

FIG. 3 is an enlarged cut-away view of the cement plug 200 of FIG. 2B. FIG. 3 more clearly shows features of the cement plug 200. It can be seen that the plug is a dual wiper plug, meaning that it is comprised lower 200L and upper 200U wiper bodies. The lower 200L and upper 200U wiper bodies each have fins 212L, 212U for wiping the inner wall of a liner 35 (shown in FIG. 6) as they travel downhole during a cementing operation. The lower 200L and upper 200U wiper bodies are separately launched, as discussed above, through the use of separate darts (not shown) that successively land in seats 217L and 217U, respectively.

The cement plug 200 also includes an inner mandrel. The inner mandrel defines a tubular body having a fluid passageway 215 along its length. In the plug 200 of FIG. 3, the mandrel is shown in two portions in order to define a lower mandrel 205L for the lower plug portion 200L, and an upper mandrel 205U for the upper plug portion 200U. The ball-releasing apparatus 100 is mounted, e.g., threaded, into the lower mandrel 205L at the mandrel's 205L lower end. The larger ball 110 is releasably suspended from the cement plug 200 via the novel releasing mechanism 100. In the arrangement of FIG. 3, the releasing mechanism 100 extends downward and outside of the mandrel 205L of the plug 200.

As can be seen from FIG. 3, the larger ball 110 is of a diameter that is greater than the diameter of bore 215 within the cement plug 200. Thus, the cement plug 200 serves as a restriction within the wellbore 10 (shown in FIG. 6) that would prevent the ball 110 from otherwise being dropped from the surface to a depth below the apparatus 100.

Returning to FIGS. 1A–1C, the body 105 of the ball-releasing apparatus 100 includes a bore 115. The bore 115 provides a passageway for fluids to flow through the body 105. The bore 115 is placed in fluid communication and in axial alignment with the bore 215 of a wellbore tool, such as the cement plug 200 of FIG. 3. The body 105 has a reduced diameter portion 107. A plurality of side ports 117 are disposed along the reduced diameter portion 107. The side ports 117 place the bore 115 of the tool body 105 in fluid communication with the wellbore (shown as 10 in FIG. 6). In this respect, the side ports 117 allow fluid to flow through the bore 215 of the cement plug 200, and then out of the ball-releasing apparatus 100 even while the larger ball 110 remains attached to the ball-releasing apparatus 100.

The lower portion of the body 105 also has an enlarged diameter portion 119. The enlarged diameter portion 119 extends below the wellbore tool 200, and serves as a ball protector. The enlarged diameter portion 119 has an inner diameter that is generally configured to conform to the radial dimension of the larger ball 110. The expanded diameter portion 119 protects the larger ball 110 from the flow of fluid and its abrasive effects as the fluid flows through the cement plug 200 and past the ball 110. The expanded diameter portion 119 also serves to prevent the larger ball 110 from becoming prematurely released.

Figure 4:
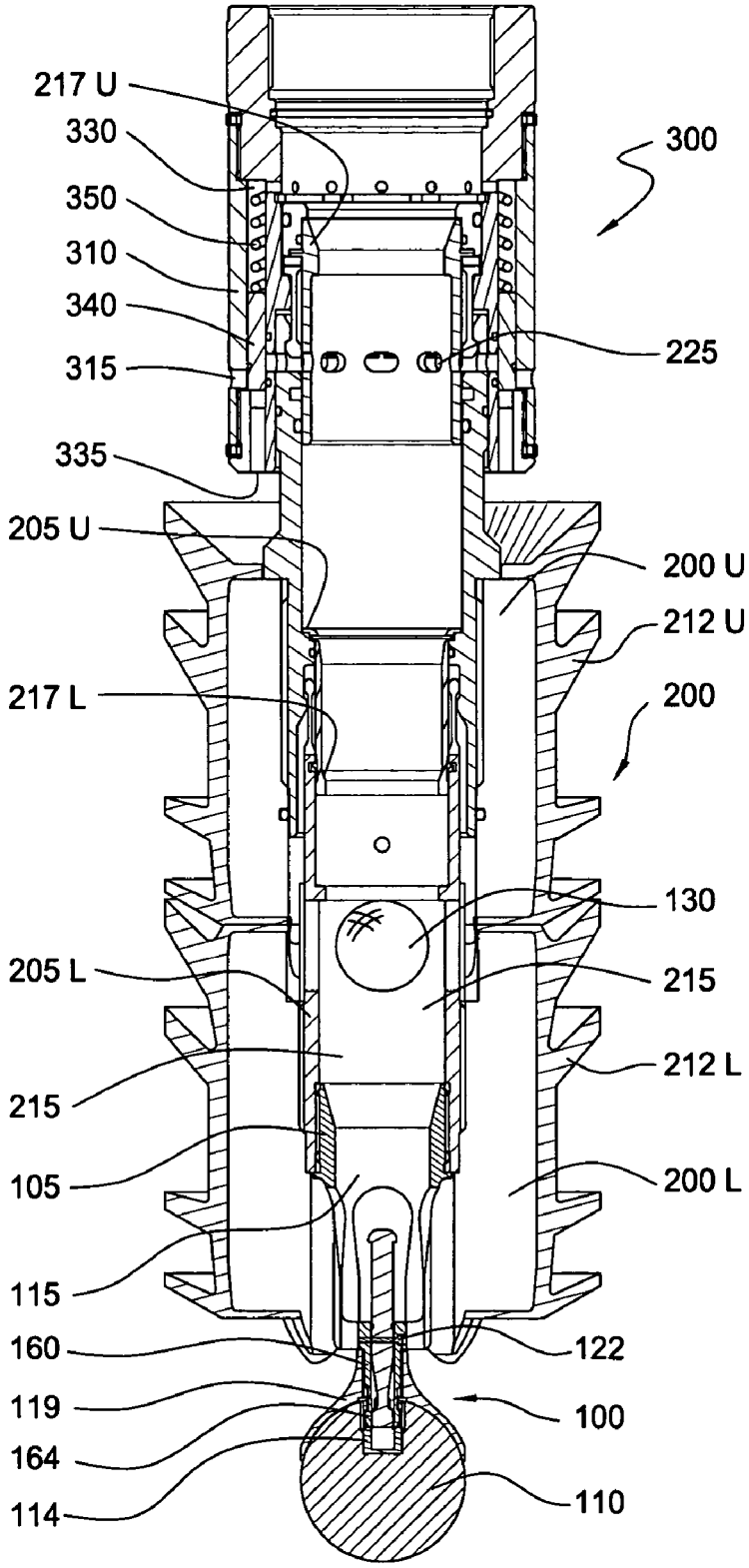
FIG. 4 presents a cross-sectional view of the cement plug of FIG. 3, showing a smaller, releasing ball being dropped into the mandrel of the plug.
Figure 5:
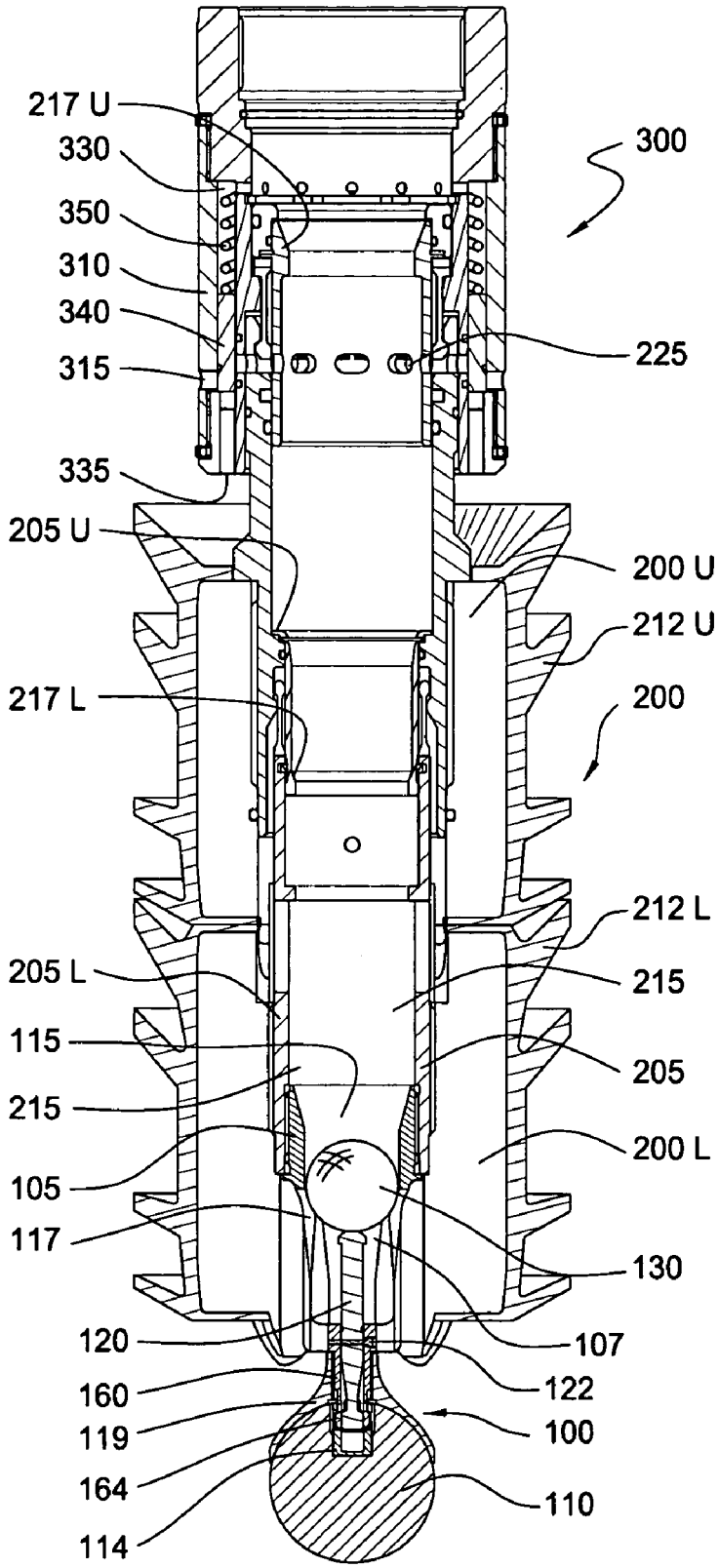
FIG. 5 depicts a cross-sectional view of the cement plug of FIG. 4, showing the smaller, releasing ball landed on a seat in the plug. The seat is provided in the bore of the plug for receiving the smaller, releasing ball.

The body 105 of the ball-releasing apparatus 100 serves as a connector between the ball-releasing apparatus 100 and the cement plug 200. However, the body 105 also serves as a seat for landing a smaller ball 130. FIG. 4 presents a cross-sectional view of the cement plug 200 of FIG. 3, showing a smaller, releasing ball 130 being dropped into the mandrel 205L of the plug 200. FIG. 5 depicts a cross-sectional view of the cement plug 200 of FIG. 4, showing the smaller, releasing ball 130 landed in the reduced diameter portion 107 of the body 105. In this respect, the reduced diameter portion 107 is configured to have an inner diameter that is only slightly larger than the diameter of the smaller ball 130 proximate to the top of the side ports 117. When the smaller ball 130 is landed into the body 105 of the ball-releasing apparatus 100, the smaller ball 130 substantially seals the bore 115. In this way, the smaller ball 130 is used to actuate the ball-releasing apparatus 100.

The ball-releasing apparatus 100 also comprises an elongated piston 120. The piston 120 is oriented along the longitudinal axis of the bore 115 of the ball-releasing apparatus 100. In the arrangement shown in FIGS. 1B and 3, a top end 124 of the piston 120 is positioned within the bore 115 of the ball releasing apparatus 100, while a lower end 126 extends out from the bottom of the plug 200. The upper end of the piston 120 defines an upper enlarged diameter portion 124 (seen best in FIG. 1B) that serves as a shoulder. The upper shoulder 124 acts to limit downward travel of the piston 120. The lower portion 126 of the piston 120, in turn, serves as a support for a lower collet 160 (discussed below) when the larger ball 110 is being run into the wellbore 10.

The piston 120 also includes a reduced diameter portion 128. The reduced diameter portion 128 is disposed intermediate the upper 124 and lower 126 portions of the piston 120. The reduced diameter portion 128 is configured to receive fingers 164 from a collet 160 when the ball-releasing apparatus 100 is actuated.

The collet 160 defines a tubular body 162 having a plurality of collet fingers 164 extending therefrom. The body 162 of the collet 160 is disposed above the larger ball 110, and around the reduced diameter portion 128 of the piston 120. The collet fingers 164, in turn, extend below the body 162. In the run-in state for the tool 100, the collet fingers 164 reside around the lower portion 126 of the piston 120. This state is shown in FIG. 1B. However, the collet fingers 164 are urged inward so as to release the larger ball 110 when the piston 120 is lowered towards the ball 110. In this respect, when the piston 120 is lowered towards the larger ball 120, the collet fingers 164 clear the lower portion 126 of the piston 120, and are received along the reduced diameter portion 128.

In one arrangement for the ball-releasing apparatus 100, a recess 112 is provided in the larger ball 110. The recess 112 is configured to receive the lower end of the piston 120. More specifically, the lower end 126 of the piston 120 is closely received within the recess 112. A shoulder 114 is provided along the surface of the recess 112. The shoulder serves as a "no-go" for entry of the lower collet fingers 164 into the recess 112 of the larger ball 110. Thus, the piston 120 may be urged into the recess 112 at a depth lower than the collet fingers 164. In this way, the collet fingers 164 may clear the lower portion 126 of the piston 120.

In the views of FIGS. 4 and 5, the larger ball 110 remains attached to the ball-releasing apparatus 100. In accordance with the purpose for the ball-releasing apparatus 100, it is desirable to selectively release the larger ball 110 from the cement plug 200. In one embodiment, the present invention employs a shearable connection 122 between the larger ball 110 to be released and the ball-releasing apparatus 100. In the arrangement of FIG. 1B, the shearable connection 122 comprises a shear pin.

Figure 6:
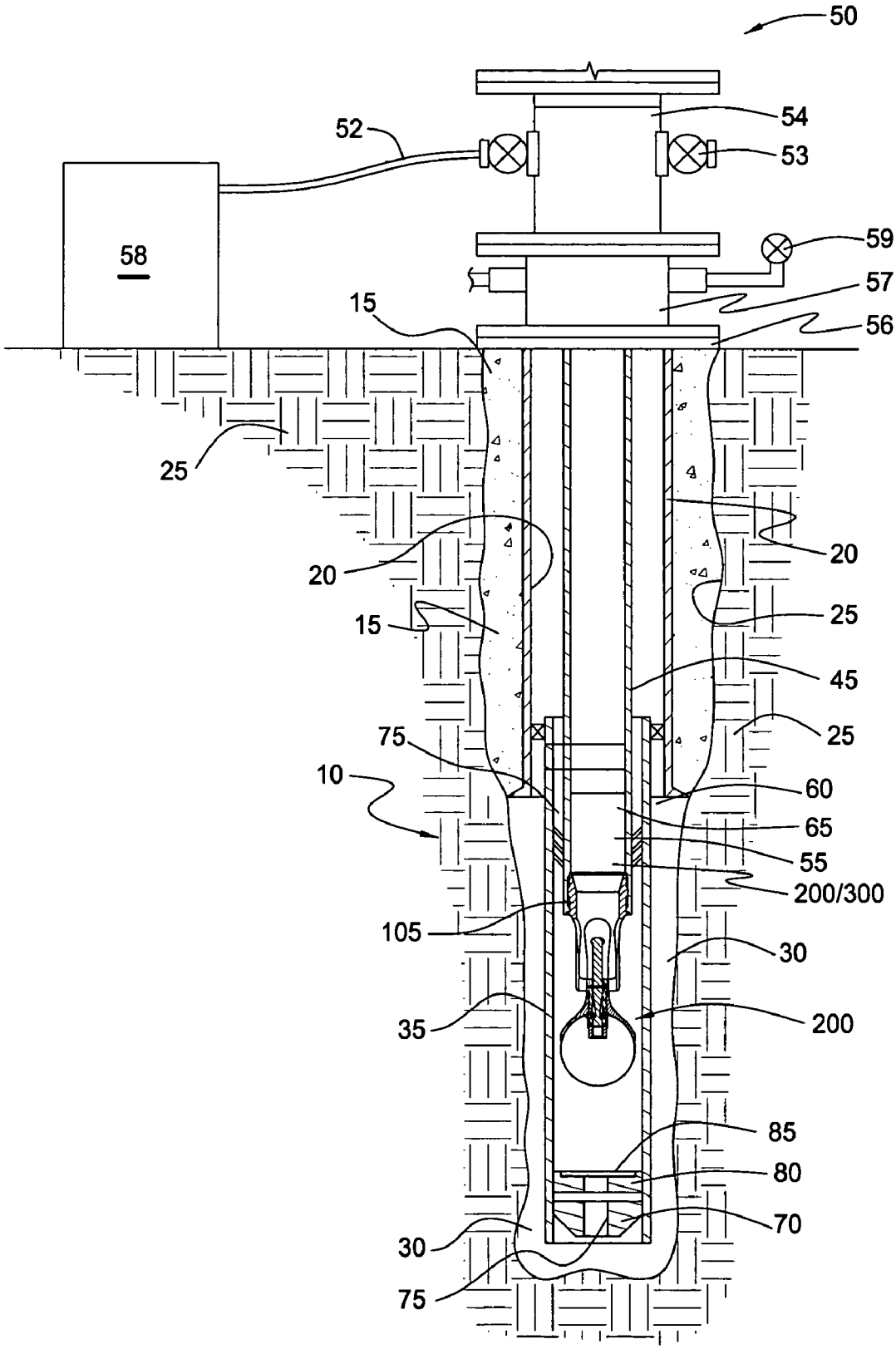
FIG. 6 demonstrates the cement plug of FIG. 3 disposed within a wellbore. In this view, the plug is connected in series with a drill string and a liner running tool, and is being run into a wellbore in connection with a cementing operation.

FIG. 6 demonstrates the ball-releasing apparatus 100 of FIG. 1B disposed within a wellbore 10. The ball-releasing apparatus 100 is again part of a cement plug 200. A cross-sectional view of the wellbore 10 is seen. As completed, the wellbore 10 has been drilled to a first depth at a first diameter, and has been lined with a string of surface casing 20. The surface casing 20 is hung from the surface. The annulus 15 between the formation and the string of surface casing 20 has been cemented. Thus, the first string 20 is fixed in the formation 25 by cured cement 15. From there, the wellbore 10 has been drilled to a second depth at a second smaller diameter, and lined with a string of intermediate casing 35. The second casing string 35, sometimes referred to as a "liner," is being run into the wellbore 10 as part of a new cementing operation. The liner 35 is being run into the wellbore 10 at the end of a drill string 45.

The cement plug 200 is shown being run into the wellbore 10. The wiper plug 200 is generally the first plug run into the wellbore 10 during liner cementing operations. The plug 200 is run into the hole before the aggregate slurry, i.e., cement, is injected so as to clean, or "wipe," the inside of the liner 35, and to isolate fluids, e.g., separate the cement column from mud. The wiper plug 200 is connected to a cross-over equalizer tool 300. The ball-releasing apparatus 100, along with the equalizer tool 300, is being run into the wellbore 10 at the lower end of the working string 45. The wiper plug 200 is designed to be released from the working string 45 and pumped through the liner 35 by a column of cement.

Various additional tools are shown in FIG. 6 to aid in the cementing operation. First, certain tools are shown within the wellbore 10 below the cement plug 200. For example, a float shoe 70 is shown at the base of the liner 35. The float shoe 70 is typically the first item of cementing equipment introduced into the wellbore 10. The shoe 70 has a rounded outer diameter and nose which acts as a guide, allowing the liner 35 to be introduced into the wellbore 10 smoothly without hanging up on ledges. The shoe 70 further includes a bore 75 which permits cement to flow therethrough en route to the formation annulus 30 during the cementing operation.

Above the float shoe 70 is a float collar 80. The float collar 80 is generally inserted one to three joints above bottom, where it serves as a back pressure valve preventing backflow of cement after placement. The float collar 80 includes a seat 85 on which the plugs 200L, 200U will land during cementing operations.

Certain tools are also shown in FIG. 6 above the plug 100. These include a running tool 65, a stinger 55, and a liner hanger 60. These are shown schematically. The liner hanger 60 employs slips which engage the inner surface of the surface casing 20 to form a frictional connection. The liner 35 is run into the wellbore on a working string 45. The liner 35 is also cemented into the wellbore 10 after being hung from the surface casing 20. It is noted that a small annular region 75 is formed between the running tool 65 and the liner 35 above the plug 200.

At the surface, the wellbore 10 is covered by a typical wellbore drilling structure 50. Visible in FIG. 6 is a casing head 56, one or more blowout preventers 57, and a cementing head shown partially at 54. One or more surface gauges are also utilized, such as a pressure gauge 59. Various fluid pumps are utilized during cementing operations, such as a cement pump 58 having a hose 52 or other fluid communication line for injecting cement downhole. Fluid gates 53 are also employed to control the flow of fluid downhole. Various other completion components are not shown, such as the drilling rig itself, aggregate shakers, various drilling fluid sources and mud pits.

As noted, the ball-releasing apparatus 100 is disposed at the lower end of the cement plug 200. To release the larger ball 110 from the ball-releasing apparatus 100, a smaller, setting ball 130 is dropped into the working string 45 and through the cement plug 200 (as shown in FIGS. 4 and 5). In operation, the smaller, ball 130 is first dropped into the wellbore 10. The smaller ball 130 will fall into the reduced diameter portion 107 of the ball-releasing apparatus 110 and on top of the piston 120. This serves to essentially seal off the side ports 117. Fluid is then injected into the working string 45 under pressure from the surface. Because the smaller ball 130 substantially seals the bore 115 of the ball-releasing apparatus 100, fluid is also restricted from flowing through the bore 215 of the cement plug 215.

As fluid pressure is increased, the smaller ball 130 will apply a downward force against the piston 120. The piston 120, in turn, acts against the shear pin 122, ultimately shearing the pin 122. The piston 120 is then able to move downwardly into the recess 112 of the larger ball 110.

Figure 7:
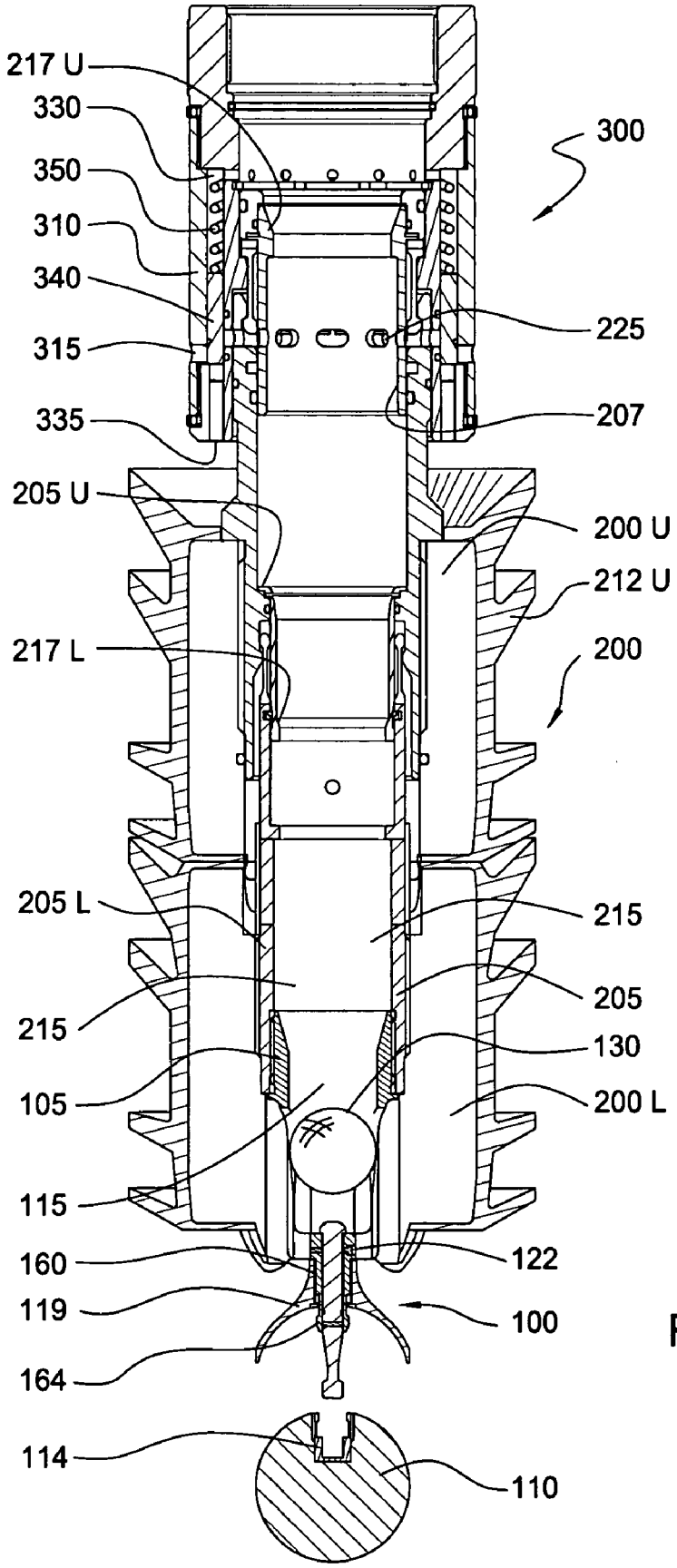
FIG. 7 presents a cross-sectional view of the ball-releasing apparatus of FIG. 5, with the larger ball being released from the plug. The cross-over apparatus remains attached to the top of the cement plug, but is in its releasing position.

After the piston 120 has traveled into the recess 112, the collet fingers 164 clear the lower enlarged diameter portion 126 of the piston 120. The collet fingers 164 are urged inwardly against the reduced diameter portion 128 of the piston 120. The piston 120 is then freed to move downwardly against the larger ball 110 even further, ultimately forcing it away from the lower portion 119 of the releasing mechanism body 105. FIG. 7 depicts a cross-sectional view of the ball-releasing apparatus 100, with the larger ball being released.

As noted, the cement plug 200 of FIGS. 2A and 2B includes not only a ball-releasing mechanism, but an integral cross-over equalizer device 300 as well. The cross-over equalizer device 300 permits an equalization of pressure inside and outside of the working string 45. More specifically, the cross-over equalizer device 300 senses a pressure differential between the inner and outer surfaces of the working string 45, and permits fluid to flow from outside of the working string 45 back into the working string 45 when pressure outside of the working string 45 is higher than that inside of the working string 45 and the plug 200.

Figure 8:
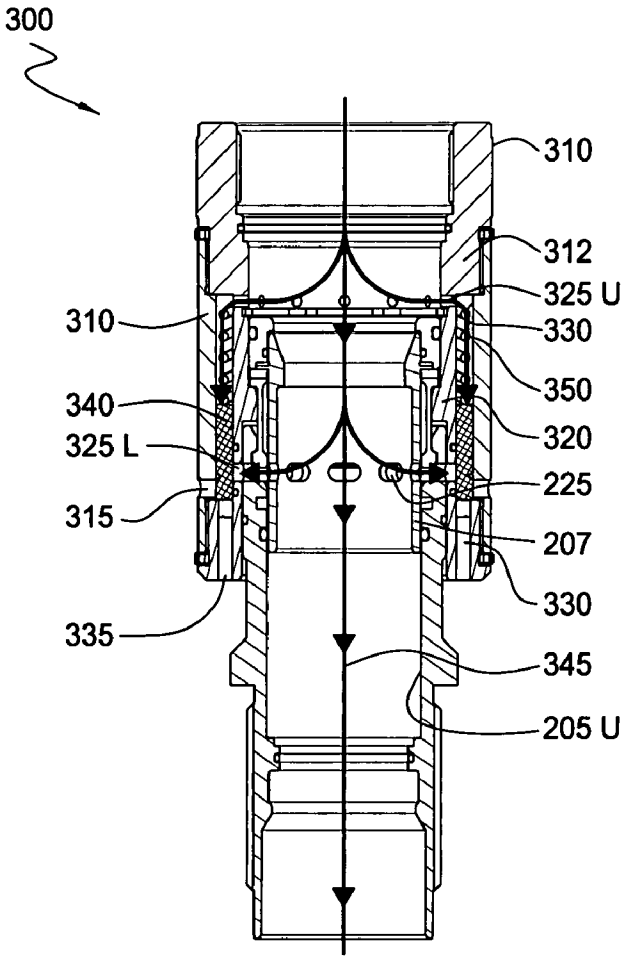
FIG. 8 is an enlarged cross-sectional view of the cross-over equalizer tool of FIG. 2B permitting fluid to pass downward from the working string and through cross-over ports of the tool. Fluid inside the tool is blocked from communication with fluid outside the tool by a piston. This is the preferred run-in position for the tool.

FIG. 8 presents an enlarged cross-sectional view of the cross-over equalizer apparatus 300 of FIG. 2B. The apparatus 300 first comprises an outer housing 310. The outer housing 310 defines a tubular body. The outer housing 310 in one aspect includes a reduced inner diameter portion 312.

The apparatus 300 further comprises an inner housing 320. The inner housing 320 also defines a tubular member, and is disposed concentrically within the outer housing 310. In the arrangement of FIGS. 3 and 8, the inner housing 320 forms a portion of the upper wiper plug mandrel 205U. In one arrangement, the upper end of the inner housing 320 abuts the reduced inner diameter portion 312 of the outer housing 310. In one aspect, the inner housing 320 is integral to the outer housing 310, that is, the housings 310, 320 define a single piece.

A fluid channel 330 is defined between the outer 310 and inner 320 housings. The fluid channel 330 is below the reduced inner diameter portion 312 of the upper housing 310. The fluid channel 330 has an opening 335 at its bottom end that exposes the fluid channel 330 to annular region 75 of the wellbore 10. The fluid channel 330 is also placed in fluid communication with the bore 215 of the plug 200 by upper 325U and lower 325L cross-over ports. The upper 325U and lower 325L cross-over ports are formed along the inner housing 320. In the arrangement of FIG. 8, the upper cross-over port 325U is immediately below the reduced inner diameter portion of the upper housing 310, while the lower cross-over port 325L is in the wall of the inner housing 320 proximal to the lower end 335 of the fluid channel 330.

Figure 9:
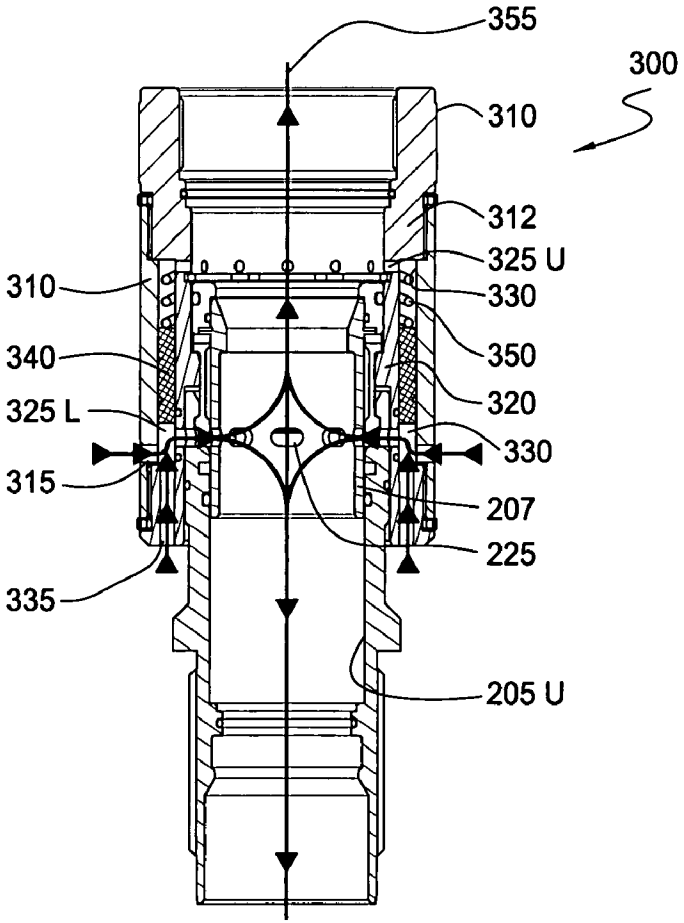
FIG. 9 is an enlarged cross-sectional view of the cross-over apparatus of FIG. 8, but with pressure acting against the cross-over equalizer tool from outside of the working string. A piston within the tool has been moved upward, thereby exposing equalizing ports and allowing fluids to return into the drill string.

The cross-over equalizer apparatus 300 also includes a sleeve 207. The sleeve 207 defines a tubular body nested within the inner housing 320. In the arrangement of FIGS. 8 and 9, the upper mandrel 205U of the cement plug 200 is received around the sleeve 207. The sleeve 207 includes ports 225. The lower cross-over port 325L is placed alongside ports 225.

One or more ports 315 are also formed in the outer housing 310. The ports 315 along the outer housing 310 serve as equalizer ports 315. In the arrangement of FIG. 8, a plurality of equalizer ports 315 are radially disposed about the outer housing 310 proximate to the lower cross-over ports 325L. The equalizer ports 315 serve to selectively place the outside of the working string 45 in fluid communication with the fluid channel 330 of the cross-over equalizer tool 300.

In order to selectively place the outside of the working string 45 in fluid communication with the fluid channel 330, a piston arrangement is provided. More specifically, a piston 340 is disposed within the fluid channel 330 itself. The piston 340 in one arrangement defines a tubular member. In the run-in position of the cross-over equalizer tool 300 (shown in FIG. 8), the piston 340 is positioned within the fluid channel 330 so as to block fluid communication between the lower cross-over ports 325L and the equalizer ports 315. A spring 350 is provided within the fluid channel 330 above the piston 340 in order to bias the piston 340 in this closed position. In the arrangement of FIG. 8, the piston 340 is suspended within the fluid channel 330 by the spring 350.

The spring 350 biases the piston 340 to seal off the fluid channel 330. In this way, the flow of fluid between the annular region 75 (outside of the liner running tool 65) and the bore 215 of the cement plug 200 is generally prohibited. However, when pressure in the annular region 75 outside of the working string 45 becomes greater than pressure inside of the cross-over equalizer tool 300, the downward biasing force of the spring 350 and of wellbore pressure above the piston 340 is overcome. The piston 340 is then raised within the fluid channel 330. When this occurs, fluid communication is achieved as between the equalizing ports 315 and the lower cross-over ports 325L.

It should be appreciated that when the upper dart (not shown) is landed in the upper seat 217U of the plug 200, the ports 225 of the sleeve 207 are isolated from fluid pressure above. The lower cross-over ports 325L also then become isolated. However, the upper cross-over ports 325U are not sealed. In this way, fluid pressure within the working string 45 may always act against the top of the piston 340, further biasing it downward. The piston 340 is only raised when pressure from below the piston 340 (via the bottom opening 335 of the fluid channel 330) is greater than the working string pressure applied above the piston 340 (via the upper cross-over ports 325U).

In the view of FIG. 8, the pressure equalizer apparatus 300 is in its run-in position. In this position, the equalizer apparatus 300 permits fluid to flow from inside the working string 45, through the upper cross-over ports 325U, and into the fluid channel 330 above the piston 340. Arrows 345 depict the path of fluid through the tool 300. It is noted that fluid cannot pass through the equalizer ports 315.

FIG. 9 presents the cross-over equalizer tool 300 in its pressure equalizing state. Arrows 355 depict the path of fluid through the tool 300. In this view, fluid is again able to travel from inside the working string 45, through the upper cross-over ports 325U, and into the fluid channel 330 above the piston 340. However, fluid is also able to travel through the lower opening 335 of the fluid channel 330 and against the bottom of the piston 340. Pressure below the piston 340 is able to overcome the forces above the piston 340. Fluid is then able to travel through the fluid channel 330 and into the bore 215 of the cement plug 200. The optional equalizer ports 315 are also placed in fluid communication with the bore 215 of the cement plug 200, thereby quickening pressure equalization.

While the foregoing is directed to embodiments of the present invention, other and further embodiments of the invention may be devised without departing from the basic scope thereof, and the scope thereof is determined by the claims that follow. In this respect, it is within the scope of the present invention to use tools other than cement plugs as the sub. Further, it is within the scope of the present invention to use any type of cement plug as the sub, including liner wiper plugs and drill pipe darts.

It should also be noted that the ball-releasing apparatus 100 and the equalizer valve 300 would have equal utility in both land-based well completions and subsea operations. In the context of subsea operations, the ball-releasing apparatus 100 and equalizer valve 300 may be run into a subsea wellbore either as part of a liner or as part of casing string suspended from a subsea casing hanger (not shown).

The invention claimed is:

1. A method for cementing a liner in a wellbore, comprising:

placing a workstring having a plug assembly in the wellbore, the plug assembly including:

a wiper plug having an equalizing mandrel, the equalizing mandrel having a fluid pathway through a wall thereof; and a valve member for selectively controlling the fluid pathway;

equalizing a pressure between an annulus formed between the workstring and the wellbore and a bore of the plug assembly by moving the valve member to allow fluid through the fluid pathway;

pumping cement through the workstring;

releasing the equalizing mandrel from the valve member thereby releasing the wiper plug from the workstring; and urging cement into an annulus formed between the liner and the wellbore.

2. The method of claim 1, further including dropping a hydraulic obstruction from the surface of the wellbore into a seat of the plug assembly.

3. The method of claim 1, wherein the plug assembly further includes a second wiper plug.

4. The method of claim 3, further including releasing the second plug from the workstring.

5. A wiper plug assembly having an equalizing mandrel, the assembly comprising:

a plug having the equalizing mandrel, wherein the mandrel includes a plurality of radial ports formed therein;

a sleeve slideably disposed concentrically around the mandrel, the sleeve configured to selectively obstruct and open the radial ports;

an outer housing disposed around the sleeve and the mandrel, the mandrel being selectively disconnectable from the housing; and a tubular member concentrically disposed adjacent the sleeve, wherein the tubular member includes a seat for receiving a hydraulic obstruction member.

6. The wiper plug of 5, wherein the sleeve is slidable between a first position and a second position.

7. The wiper plug of claim 6, wherein the sleeve is biased in the first position by a biasing member, thereby obstructing the radial ports.

8. The wiper plug of claim 5, wherein the sleeve includes a plurality of radial ports formed in a wall thereof.

9. The wiper plug of claim 5, wherein the tubular member includes a plurality of radial ports formed in a wall thereof.

10. A wiper plug assembly, comprising:

an outer housing;

a plug having an equalizing mandrel, the mandrel having a fluid pathway through a wall thereof and the mandrel releaseably disposed within the outer housing;

a movable valve member disposed concentrically around the equalizing mandrel, the valve member configured to selectively control the fluid pathway; and an inner housing concentrically disposed adjacent the valve member, wherein the inner housing includes a seat configured to receive a hydraulic obstruction member.

11. The wiper plug of claim 10, wherein the inner housing includes a plurality of radial ports formed in a wall thereof.

12. The wiper plug of 10, wherein the valve member is movable between an open position and a closed position.

13. The wiper plug of 12, further including a biasing member to bias the valve member in the closed position.

14. A wiper plug assembly, comprising:

an outer housing;

a plug having an equalizing mandrel, the mandrel having a fluid pathway through a wall thereof and the mandrel releaseably disposed within the outer housing; and a movable valve member disposed concentrically around the equalizing mandrel, the valve member configured to selectively control the fluid pathway, wherein the valve member includes a plurality of radial ports formed in a wall thereof.

* * * * *